US012352472B2

(12) United States Patent
Hollister

(10) Patent No.: US 12,352,472 B2
(45) Date of Patent: Jul. 8, 2025

(54) COOLING SYSTEM

(71) Applicant: Heatcraft Refrigeration Products LLC, Stone Mountain, GA (US)

(72) Inventor: Michael Hollister, Atlanta, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 97 days.

(21) Appl. No.: 16/460,445

(22) Filed: Jul. 2, 2019

(65) Prior Publication Data

US 2021/0003322 A1 Jan. 7, 2021

(51) Int. Cl.

| | |
|---|---|
| ***F25B 1/10*** | (2006.01) |
| ***F25B 5/02*** | (2006.01) |
| ***F25B 41/20*** | (2021.01) |
| ***F25B 41/40*** | (2021.01) |

(52) U.S. Cl.

CPC ..... *F25B 1/10* (2013.01); *F25B 5/02* (2013.01); *F25B 41/20* (2021.01); *F25B 41/40* (2021.01); *F25B 2400/075* (2013.01)

(58) Field of Classification Search

CPC ..... F25B 47/02; F25B 47/022; F25B 47/025; F25B 41/003; F25B 2341/021; F25B 2341/023; F25B 2347/02; F25B 1/10; F25B 5/02; F25B 41/20; F25B 41/40; F25B 2400/075; F25B 2400/16; F25B 9/008; F25B 2400/23

See application file for complete search history.

(56) References Cited

U.S. PATENT DOCUMENTS 2,974,682 A * 3/1961 Trask ..... F25B 13/00 137/625.33
3,365,905 A * 1/1968 Barbier ..... F25B 41/20 62/217
3,645,109 A * 2/1972 Quick ..... F25B 1/00 62/196.2

(Continued)

FOREIGN PATENT DOCUMENTS

JP H07218011 A * 8/1995
WO WO 2011054397 A1 * 5/2011 ..... F25B 47/022

OTHER PUBLICATIONS

NPL_Defrosting Refrigeration Systems_ Keep it Short and Sweet_ Contracting Business (2006) (Year: 2006).*

(Continued)

*Primary Examiner* — Elizabeth J Martin
*Assistant Examiner* — Dario Antonio Deleon
(74) *Attorney, Agent, or Firm* — Baker Botts L.L.P.

(57) ABSTRACT

An apparatus includes a load, a compressor, a first pipe coupled to the load, a second pipe coupled to the compressor, a third pipe coupled to the first pipe and the second pipe, a fourth pipe coupled to the first pipe and the second pipe, and a check valve coupled to the fourth pipe. During a first mode of operation: the load uses a refrigerant to cool a space proximate the load, the first, second, and third pipes direct refrigerant from the load to the compressor, the compressor compresses refrigerant from the load, and the check valve prevents refrigerant from the load from flowing to the compressor through the fourth pipe. During a second mode of operation the first, second, and fourth pipes direct a first portion of the refrigerant from the compressor to the load to defrost the load.

15 Claims, 3 Drawing Sheets

(56) References Cited

U.S. PATENT DOCUMENTS 3,664,150 A * 5/1972 Patterson ..... F25B 5/02 62/234
3,766,745 A * 10/1973 Quick ..... F25B 5/00 62/196.2
4,171,622 A * 10/1979 Yamaguchi ..... F25B 13/00 62/160
4,503,685 A * 3/1985 DiCarlo ..... G05D 23/126 62/193
4,530,219 A * 7/1985 Aleksandrow ..... F25B 5/02 62/503
5,463,878 A * 11/1995 Parekh ..... A23G 9/28 222/146.6
5,575,158 A * 11/1996 Vogel ..... F25B 47/022 62/196.4
5,673,567 A * 10/1997 Dube ..... F25B 6/00 62/117
5,694,782 A * 12/1997 Alsenz ..... F25B 5/02 62/278
6,244,059 B1 * 6/2001 Hill ..... F25B 31/004 62/193
6,286,322 B1 * 9/2001 Vogel ..... F25B 47/025 62/81
RE43,458 E * 6/2012 Cleland ..... F25B 49/02 62/196.1
8,256,739 B2 * 9/2012 Pfaff ..... F15B 13/0405 251/30.02
8,997,509 B1 * 4/2015 Wiggs ..... F25B 30/02 62/234
9,982,919 B2 * 5/2018 Ali et al. ..... F25B 31/008
10,496,108 B2 * 12/2019 Cole et al. ..... F25B 9/008
10,808,975 B2 * 10/2020 Zha ..... F25B 47/022
10,830,499 B2 * 11/2020 Rajendiran et al. ..... F25B 5/02
2005/0223722 A1 * 4/2005 Yamashita et al. ..... F25B 5/02 62/157
2005/0257564 A1 * 11/2005 Wightman ..... F25B 41/04 62/510
2008/0016896 A1 * 1/2008 Rasch ..... F25B 47/02 62/278
2008/0041079 A1 * 2/2008 Nishijima et al. .... F25B 47/022 62/191
2014/0096553 A1 * 4/2014 Satou et al. ..... F25B 49/022 62/180
2014/0352343 A1 * 12/2014 Hinde et al. ..... F25B 7/00 62/277
2015/0292789 A1 * 10/2015 Takenaka et al. .... F25D 21/006 62/140
2016/0209100 A1 * 7/2016 Jentzsch ..... F25B 47/025
2017/0176077 A1 * 6/2017 Knatt ..... F25B 47/022
2017/0284715 A1 * 10/2017 Mukherjee ..... F25B 40/00
2017/0292769 A1 * 10/2017 Laurentius ..... F25B 41/22
2018/0195773 A1 * 7/2018 Saunders ..... F25B 41/20
2018/0252441 A1 * 9/2018 Zha ..... F25B 5/02 62/234
2019/0203997 A1 * 7/2019 Sakae et al. ..... F25B 1/00
2019/0376732 A1 * 12/2019 Zha ..... F25B 1/10
2020/0003468 A1 * 1/2020 Hollister ..... F25B 41/00
2020/0132351 A1 * 4/2020 Zha ..... F25B 1/10
2020/0200439 A1 * 5/2020 Akizuki et al. ..... F28F 9/02
2020/0191457 A1 * 6/2020 Zha ..... F25B 41/00
2020/0332166 A1 * 10/2020 Kumakura et al. ..... F24F 11/65

OTHER PUBLICATIONS

NPL_Where Are the Best Places to Install Your Split AC Unit (2015) (Year: 2015).*
Bi-Directional Check Valves, BoschRexroth (2012) (Year: 2012).*
Stepping_Motor_Valve, Dakota_Instruments (2017), accessed 2022, https://web.archive.org/web/20190608220545/https://www.dakotainstruments.com/stepping-motor-valve-6asmv010 (Year: 2017).*
Takano et al., Refrigerator, JPH07218011A, Machine Translation (Year: 1995).*

* cited by examiner

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

One way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle may direct refrigerant from a low temperature load to a low temperature compressor through a suction line that is effectively a pipe or tube with a small diameter (e.g., less than or equal to ⅜ of an inch). During a regular refrigeration cycle, this small diameter allows refrigerant to be suctioned into the compressor while preventing oil in the refrigerant from flowing back to the low temperature load (e.g., when the low temperature load is installed vertically lower than the low temperature compressor). During a defrost cycle, hot gas is directed from the low temperature compressor to the low temperature load through this suction line. The small diameter of the suction line, however, restricts the flow of hot gas from the low temperature compressor to the load. As a result, it may take a long time to defrost the low temperature load.

This disclosure contemplates an unconventional cooling system that increases hot gas flow during a defrost cycle by including an additional hot gas line with a larger diameter (e.g., greater than or equal to ⅝ of an inch) between the load and the compressor. The hot gas line includes a check valve that prevents refrigerant from the load from flowing to the compressor through the hot gas line. During a refrigeration cycle, the refrigerant from the load is suctioned into the compressor through the small diameter suction line. During the defrost cycle, hot gas from the compressor is directed through the hot gas line and the check valve to the load. Because the hot gas line has a larger diameter than the suction line, the flow of hot gas to the load is increased during the defrost cycle. As a result of the increased flow of hot gas, the hot gas defrost process speeds up. Certain embodiments of the cooling system are described below.

According to an embodiment, an apparatus includes a load, a compressor, a first pipe coupled to the load, a second pipe coupled to the compressor, a third pipe coupled to the first pipe and the second pipe, a fourth pipe coupled to the first pipe and the second pipe, and a check valve coupled to the fourth pipe. During a first mode of operation: the load uses a refrigerant to cool a space proximate the load, the first, second, and third pipes direct refrigerant from the load to the compressor, the compressor compresses refrigerant from the load, and the check valve prevents refrigerant from the load from flowing to the compressor through the fourth pipe. During a second mode of operation the first, second, and fourth pipes direct a first portion of the refrigerant from the compressor to the load to defrost the load.

According to another embodiment, a method includes removing, by a high side heat exchanger, heat from a refrigerant and storing, by a flash tank, the refrigerant. The method also includes using, by a first load, the refrigerant to cool a first space proximate the first load and using, by a second load, the refrigerant to cool a second space proximate the second load. The method further includes during a first mode of operation: using, by a third load, the refrigerant to cool a third space proximate the third load, directing, by a first pipe coupled to the third load, a second pipe coupled to a first compressor, and a third pipe coupled to the first pipe and the second pipe, refrigerant from the third load to the first compressor, compressing, by the first compressor, the refrigerant from the second load and the third load, compressing, by a second compressor, the refrigerant from the first load and the first compressor, and preventing, by a check valve coupled to a fourth pipe coupled to the first pipe and the second pipe, refrigerant from the third load from flowing to the first compressor through the fourth pipe. The method also includes during a second mode of operation, directing, by the first, second, and fourth pipes, a first portion of the refrigerant from the first compressor to the third load to defrost the third load.

According to yet another embodiment, a system includes a high side heat exchanger that removes heat from a refrigerant, a flash tank that stores the refrigerant, a first load that uses the refrigerant to cool a first space proximate the first load, a second load that uses the refrigerant to cool a second space proximate the second load, a third load, a first compressor, a second compressor, a first pipe coupled to the third load, a second pipe coupled to a first compressor, a third pipe coupled to the first pipe and the second pipe, a fourth pipe coupled to the first pipe and the second pipe, and a check valve coupled to the fourth pipe. During a first mode of operation: the third load uses the refrigerant to cool a third space proximate the third load, the first, second, and third pipes direct the refrigerant from the third load to the first compressor, the first compressor compresses the refrigerant from the second load and the third load, the second compressor compresses the refrigerant from the first load and the first compressor, and the check valve prevents the refrigerant from the third load from flowing to the first compressor through the fourth pipe. During a second mode of operation, the first, second, and fourth pipe direct a first portion of the refrigerant from the first compressor to the third load to defrost the third load.

Certain embodiments provide one or more technical advantages. For example, an embodiment increases the speed of a hot gas defrost cycle by increasing the flow of hot gas to a load. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which:

FIG. 1.

DETAILED DESCRIPTION

Figure 1:
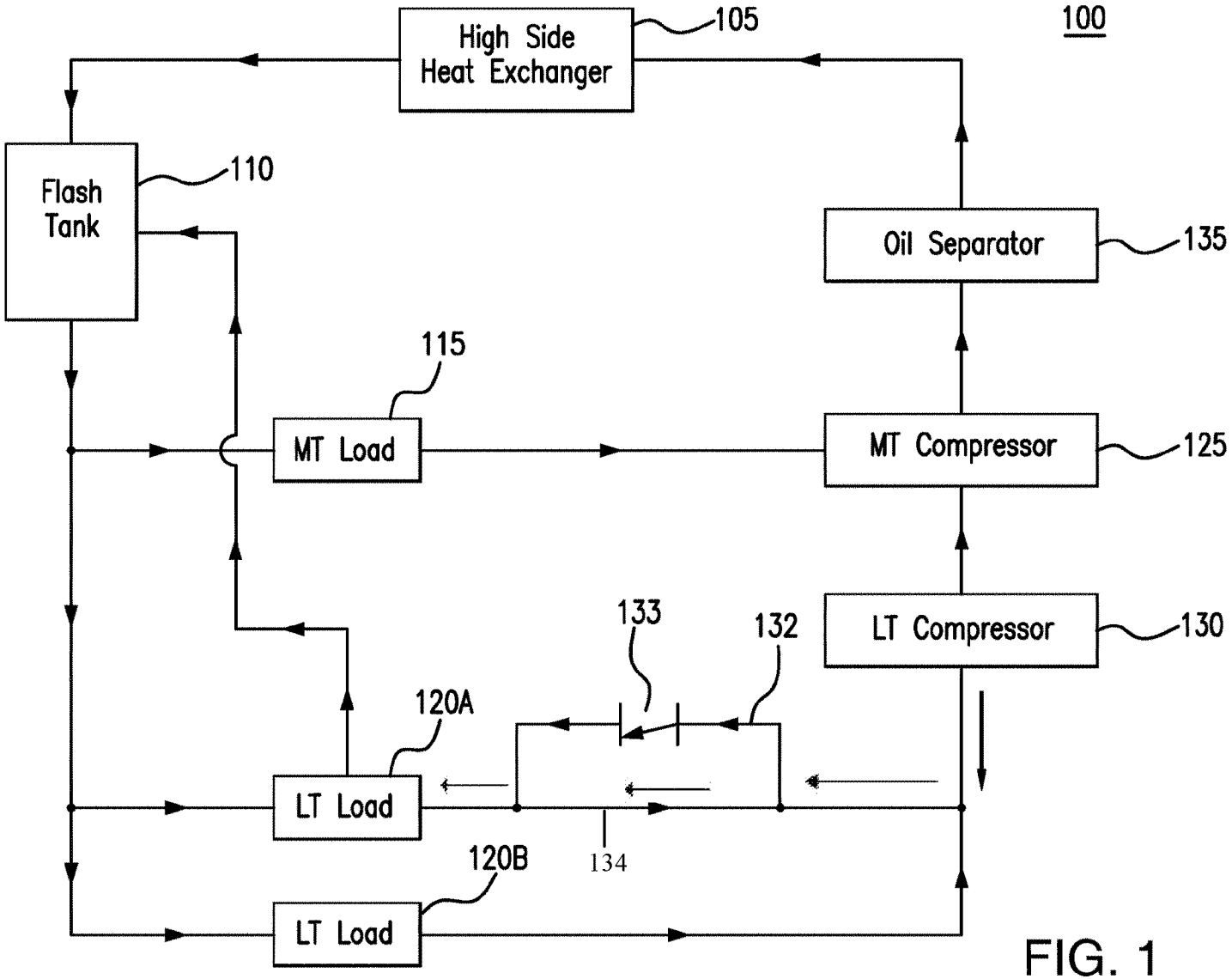
FIG. 1 illustrates an example cooling system.
Figure 2:
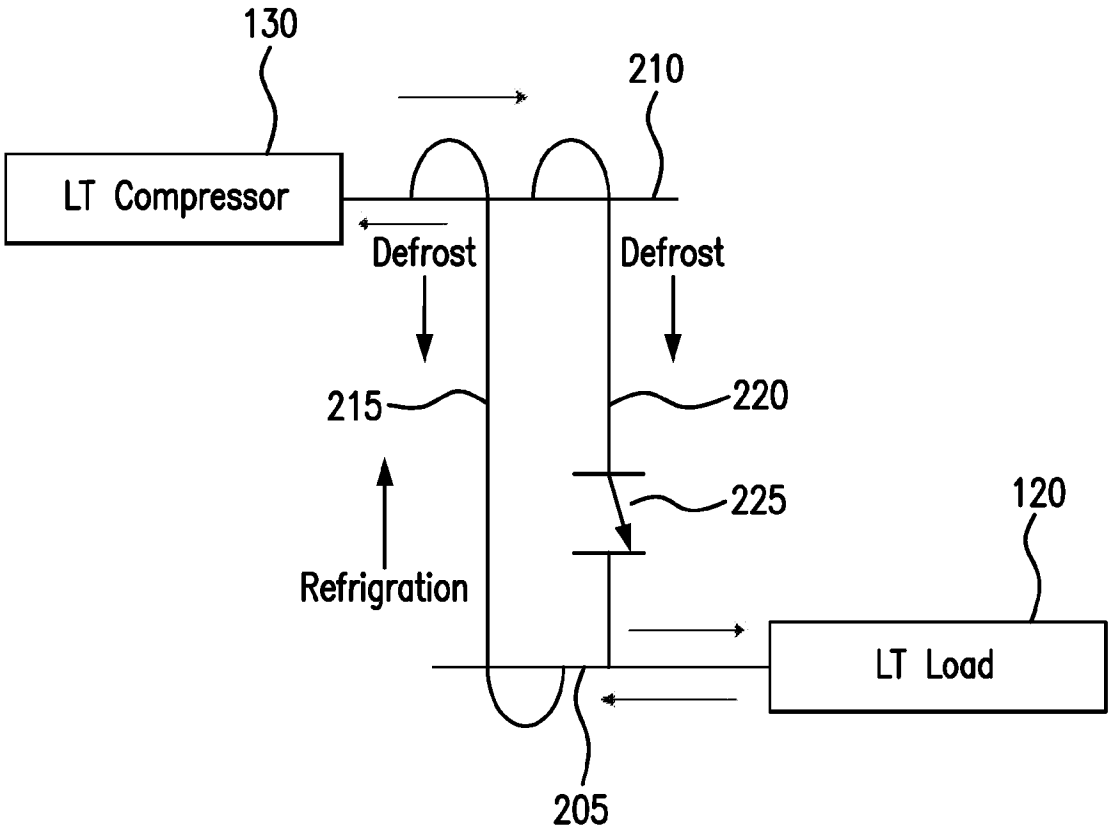
FIG. 2 illustrates a portion of the example cooling system of FIG.
Figure 3:
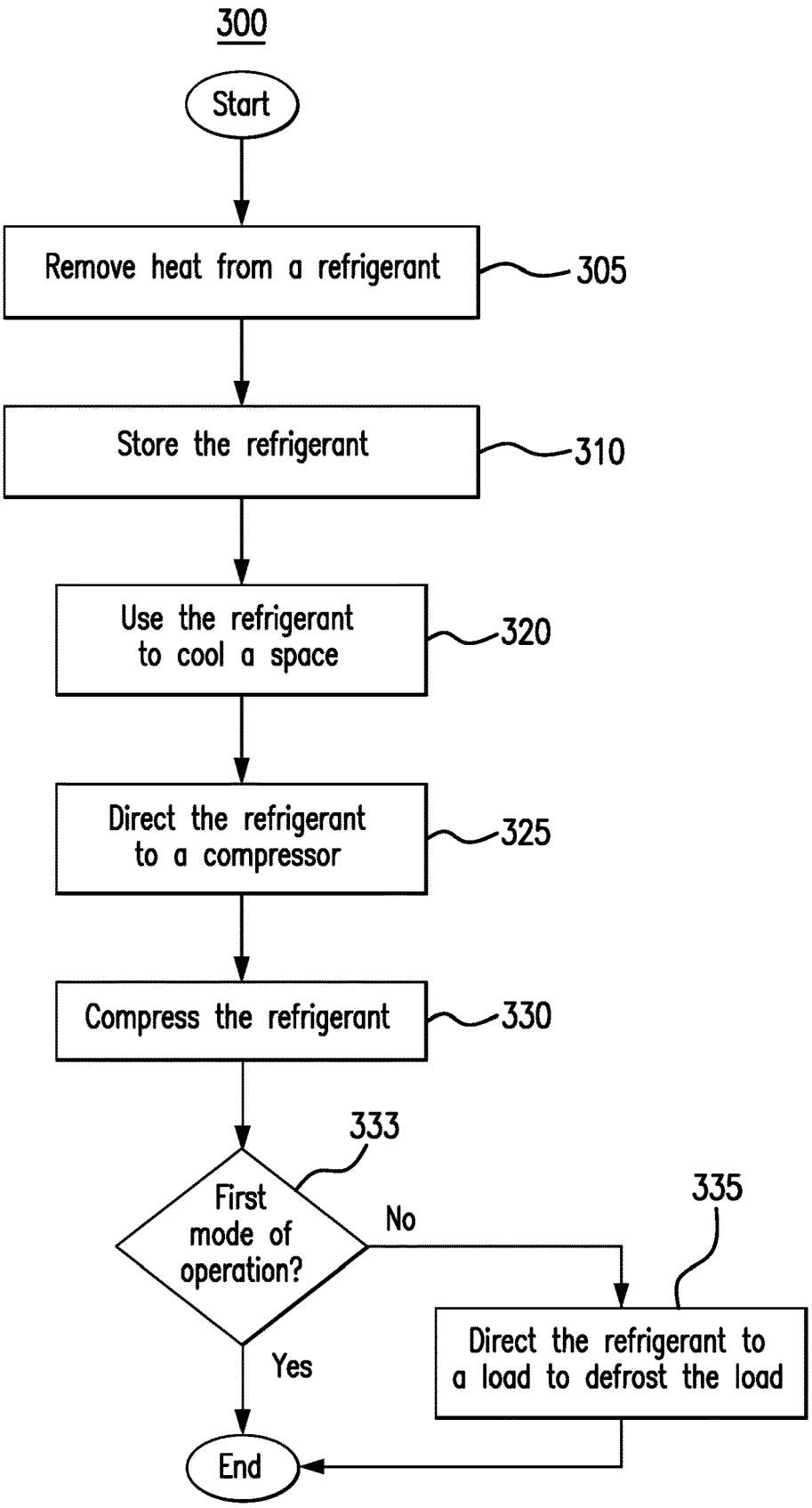
FIG. 3 is a flowchart illustrating a method of operating the example cooling system of FIG. 1.

Embodiments of the present disclosure and its advantages are best understood by referring to FIGURES FIGS. 1 through 3 of the drawings, like numerals being used for like and corresponding parts of the various drawings.

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

One way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle may direct refrigerant from a low temperature load to a low temperature compressor through a suction line that is effectively a pipe or tube with a small diameter (e.g., less than or equal to ⅜ of an inch). During a regular refrigeration cycle, this small diameter allows refrigerant to be suctioned into the compressor while preventing oil in the refrigerant from flowing back to the low temperature load (e.g., when the low temperature load is installed vertically lower than the low temperature compressor). During a defrost cycle, hot gas is directed from the low temperature compressor to the low temperature load through this suction line. The small diameter of the suction line, however, restricts the flow of hot gas from the low temperature compressor to the load. As a result, it may take a long time to defrost the low temperature load.

This disclosure contemplates an unconventional cooling system that increases hot gas flow during a defrost cycle by including an additional hot gas line with a larger diameter (e.g., greater than or equal to ⅝ of an inch) between the load and the compressor. The hot gas line includes a check valve that prevents refrigerant from the load from flowing to the compressor through the hot gas line. During a refrigeration cycle, the refrigerant from the load is suctioned into the compressor through the small diameter suction line. During the defrost cycle, hot gas from the compressor is directed through the hot gas line and the check valve to the load. Because the hot gas line has a larger diameter than the suction line, the flow of hot gas to the load is increased during the defrost cycle. As a result of the increased flow of hot gas, the hot gas defrost process speeds up.

The cooling system will be described using FIGURES FIGS. 1 through 3.

FIG. 1 illustrates an example cooling system 100. As shown in FIG. 1, system 100 includes a high side heat exchanger 105, a flash tank 110, a medium temperature load 115, low temperature loads 120A and 120B, a medium temperature compressor 125, a low temperature compressor 130, and an oil separator 135.

System 100 allows for hot gas to be circulated to low temperature load 120A to defrost low temperature load 120A. After defrosting low temperature load 120A, the hot gas and/or refrigerant is cycled back to flash tank 110. This disclosure contemplates cooling system 100 or any cooling system described herein including any number of loads, whether low temperature or medium temperature. Additionally, this disclosure contemplates hot gas from low temperature compressor 130 being directed to low temperature load 120B to defrost load 120B.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature loads 120A and 120B and medium temperature load 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature loads 120A and 120B and medium temperature load 115. When the refrigerant reaches low temperature loads 120A and 120B or medium temperature load 115, the refrigerant removes heat from the air around low temperature loads 120A and 120B or medium temperature load 115. As a result, the air is cooled. The cooled air may then be circulated such as, for example, by a fan to cool a space such as, for example, a freezer and/or a refrigerated shelf. As refrigerant passes through low temperature loads 120A and 120B and medium temperature load 115, the refrigerant may change from a liquid state to a gaseous state as it absorbs heat. This disclosure contemplates including any number of low temperature loads 120 and medium temperature loads 115 in any of the disclosed cooling systems.

The refrigerant cools metallic components of low temperature loads 120A and 120B and medium temperature load 115 as the refrigerant passes through low temperature loads 120A and 120B and medium temperature load 115. For example, metallic coils, plates, parts of low temperature loads 120A and 120B and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice act as a thermal barrier. As a result, the efficiency of cooling system 100 decreases the more ice and frost that accumulates. Cooling system 100 may use heated refrigerant to defrost these metallic components.

Refrigerant flows from low temperature loads 120A and 120B and medium temperature load 115 to compressors 125 and 130. This disclosure contemplates the disclosed cooling systems including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature loads 120A and 120B and sends the compressed refrigerant to medium temperature compressor 125. Medium temperature compressor 125 compresses a mixture of the refrigerant from low temperature compressor 130 and medium temperature load 115. Medium temperature compressor 125 then sends the compressed refrigerant to high side heat exchanger 105.

Refrigerant from low temperature compressor 130 may be cycled back to low temperature load 120A to defrost low temperature load 120. The refrigerant may be heated after absorbing heat from the other low temperature loads 120 and being compressed by low temperature compressor 130. The hot refrigerant and/or hot gas is then cycled over the metallic components of the low temperature load 120A to defrost it. Afterwards, the hot gas and/or refrigerant is cycled back to flash tank 110. This process of cycling heated refrigerant over low temperature load 120A to defrost it is referred to as a defrost cycle. This disclosure contemplates directing hot refrigerant from low temperature compressor 130 to any suitable low temperature load 120. Additionally, it is contemplated that during the defrost cycle, the load 120 that is being defrosted is turned off, and the hot gas used to defrost the load 120 is supplied by another load 120 that is operating. For example, if load 120A is being defrosted, then load 120A may be turned off and the hot gas used to defrost load 120A is supplied by load 120B, which is kept operating during the defrost cycle.

Medium temperature compressor 125 directs refrigerant to high side heat exchanger 105 through oil separator 135. Oil separator 135 separates an oil from the refrigerant from medium temperature compressor 125. By separating the oil from the refrigerant, oil separator 135 prevents the oil from flowing to other components of system 100. If oil flows to these other components, the oil may damage and/or clog these other components. Thus, oil separator 135 improves the efficiency and lifespan of system 100. Particular embodiments of system 100, do not include oil separator 135.

Existing cooling systems may direct refrigerant from a low temperature load to a low temperature compressor through a suction line that is effectively a pipe or tube with a small diameter (e.g., less than or equal to ⅜ of an inch). During a regular refrigeration cycle, this small diameter allows refrigerant to be suctioned into the compressor while preventing oil in the refrigerant from flowing back to the low temperature load. During a defrost cycle, hot gas is directed from the low temperature compressor to the low temperature load through this suction line. The small diameter of the suction line, however, restricts the flow of hot gas from the low temperature compressor to the load. As a result, it may take a long time to defrost the low temperature load.

System 100 increases hot gas flow during a defrost cycle by including an additional hot gas line 132 with a larger diameter (e.g., greater than or equal to ⅝ of an inch) between the load 120A and the compressor 130. The hot gas line 132 includes a check valve 133 that prevents refrigerant from the load 120A from flowing to the compressor 130 through the hot gas line 132.

During a refrigeration cycle, the refrigerant from the load 120A is suctioned into the compressor 130 through a small diameter suction line 134. During the defrost cycle, hot gas from the compressor 130 is directed through the hot gas line 132 and the check valve 133 to the load 120A. Because the hot gas line 132 has a larger diameter than the suction line 134, the flow of hot gas to the load 120A is increased during the defrost cycle.

As a result of the increased flow of hot gas, the hot gas defrost process speeds up. Embodiments of the cooling system are described below using FIGURES FIGS. 2 and 3.

FIG. 2 illustrates a portion of the example cooling system 100 of FIGURE FIG. 1. As seen in FIG. 2, the portion of cooling system 100 includes low temperature load 120, low temperature compressor 130, a first pipe 205, a second pipe 210, a third pipe 215, a fourth pipe 220, and a check valve 225. Generally, during a refrigeration cycle, refrigerant from low temperature load 120 is suctioned through pipes 205, 210, and 215 to low temperature compressor 130. Pipe 215 may be referred to as a suction line. During a defrost cycle, refrigerant from low temperature compressor 130 is directed to low temperature load 120 through pipes 205, 210, and 220. Pipe 220 may be referred to as a hot gas line. Because pipe 220 is larger than pipe 215, the flow of refrigerant to low temperature load 120 during the defrost cycle is less restricted compared to when the refrigerant flowed through pipe 215. As a result, the defrost cycle speeds up.

Pipe 205 is coupled to low temperature load 120. Pipe 205 allows refrigerant to flow in and out of low temperature load 120. Pipe 210 is coupled to low temperature compressor 130. Pipe 210 allows refrigerant to flow in and out of low temperature compressor 130. In certain embodiments, pipes 205 and 210 may be similarly sized. For example, both pipes 205 and 210 may have a diameter of ⅝ of an inch.

Pipe 215 is coupled to pipes 205 and 210. In certain embodiments, pipe 215 may be referred to as a suction line. Pipe 215 may take form of a rigid pipe and/or a flexible tube.

In certain embodiments pipe 215 has a diameter that is smaller than the diameters of pipes 205, 210, and 220. For example, pipe 215 may have a diameter of ⅜ of an inch.

During a first mode of operation (e.g., a regular refrigeration cycle), low temperature load 120 uses refrigerant to cool a space proximate low temperature load 120. That refrigerant is then suctioned through pipes 205, 215, and 210 to low temperature compressor 130. Because pipe 215 has a smaller diameter, the refrigerant is suctioned through pipe 215 at a higher velocity than through other pipes. As a result, an oil that is mixed with the refrigerant from low temperature load 120 may be suctioned upwards through pipe 215 to low temperature compressor 130 at that higher velocity. If pipe 215 had a larger diameter, then the refrigerant and the oil may not be suctioned at a higher velocity and the oil may flow back from pipe 215 to low temperature load 120. In certain installations, low temperature compressor 130 is positioned vertically higher than low temperature load 120. In these installations, gravity may further act on the oil and the refrigerant and cause the oil to flow back down towards low temperature load 120 if the oil is not suctioned at a sufficient velocity. This disclosure contemplates that low temperature load 120 and low temperature compressor 130 being installed at any vertical position relative to each other. Even when low temperature compressor 130 is installed lower vertically than low temperature load 120, there may still be a pipe between the low temperature load 120 and the low temperature compressor that runs vertically upwards, which may result in backflow.

During a second mode of operation (e.g., a defrost cycle), refrigerant from low temperature compressor 130 is directed back to low temperature load 120 to defrost low temperature load 120. If pipe 215 were the only passageway for refrigerant to flow from low temperature compressor 130 to low temperature load 120, the small diameter of pipe 215 would restrict the flow of the refrigerant. As a result, the flow of refrigerant back to low temperature load 120 is slowed, which may cause the defrost process to take a long time.

Pipe 220 allows for an increased flow of refrigerant to low temperature load 120 during the second mode of operation. Pipe 220 is coupled to pipes 205 and 210. Pipe 220 has a larger diameter than pipe 215. For example, pipe 220 may have a diameter of ⅝ of an inch. Because of the larger diameter, pipe 220 allows for an increased flow of refrigerant relative to pipe 215. This disclosure contemplates that pipe 220 may have a diameter that is equal to the diameters of pipes 205 and 210 or a diameter that is smaller than the diameters of pipes 205 and 210.

Check valve 225 is coupled to pipe 220. Check valve 225 prevents refrigerant from flowing through pipe 220 in a certain direction.

As seen in FIG. 2, check valve 225 prevents refrigerant in pipe 205 from flowing to pipe 210 through pipe 220. Rather, check valve 225 allows refrigerant in pipe 210 to flow to pipe 205 through pipe 220. Thus, during the first mode of operation, check valve 225 prevents refrigerant from flowing through pipe 220. If refrigerant did flow from pipe 205 to pipe 210 through pipe 220, an oil mixed with the refrigerant may flow back towards load 120 due to gravity. During the second mode of operation, check valve 225 allows refrigerant to flow through pipe 220 to defrost low temperature load 120.

As a result, check valve 225 prevents refrigerant from flowing upwards through pipe 220 during a refrigeration cycle. As a result, oil that is mixed with the refrigerant is prevented from flowing back to low temperature load 120 due to gravity. During a defrost cycle, check valve 225 allows refrigerant to flow from low temperature compressor 130 to low temperature load 120 through pipe 220. Because pipe 220 has a larger diameter than pipe 215, pipe 220 allows for an increased flow of refrigerant back to low temperature load 120 to defrost load 120. As a result, the defrost process speeds up.

In certain instances, during a defrost cycle, a portion of the refrigerant from low temperature compressor 130 flows to low temperature load 120 through pipe 215. This portion of the refrigerant that flows through pipe 215 is smaller than the portion of the refrigerant that flows through pipe 220, because pipe 220 has a larger diameter than pipe 215. As a result, pipe 215 still allows refrigerant to flow form low temperature compressor 130 to low temperature load 120, and this refrigerant supplements the refrigerant that flows through pipe 220 to low temperature load 120. This increased flow of refrigerant from low temperature compressor 130 further speeds up the defrost process.

FIG. 3 is a flow chart illustrating a method 300 of operating the example cooling system 100 of FIG. 1. In particular embodiments, certain components of system 100 perform the steps of method 300. By performing method 300, system 100 allows for an increased flow of hot gas to a load during the defrost cycle to increase the speed of the defrost process.

In step 305, a high side heat exchanger removes heat from a refrigerant. A flash tank stores the refrigerant in step 310. In step 320, a load uses the refrigerant to cool a space. Pipes direct the refrigerant to a compressor in step 325. These pipes may include a suction line that has a small diameter, such as, for example, ⅜ of an inch. The compressor then compresses the refrigerant in step 330. In step 333, a determination is made whether the system 100 is in a first mode of operation. If a system is in the first mode of operation, then the system 100 is in a refrigeration cycle and the compressed refrigerant can be directed back to the high side heat exchanger.

If system 100 is not in the first mode of operation, then system 100 is in a defrost cycle. In step 335, pipes direct the refrigerant to a load to defrost the load. These pipes include a hot gas line with a check valve that allows the refrigerant to flow from the compressor to the load but not in the other direction. The hot gas line has a larger diameter than the suction line, which allows for an increased flow of refrigerant back to the load to defrost the load. As a result, the speed of the hot gas cycle is increased. The load that is defrosted in step 335 may not be the same load that used the refrigerant to cool the space in step 320, because the load that is defrosted in step 335 may be shut off during the defrost cycle.

Modifications, additions, or omissions may be made to method 300 depicted in FIG. 3. Method 300 may include more, fewer, or other steps. For example, steps may be performed in parallel or in any suitable order. While discussed as system 100 (or components thereof) performing the steps, any suitable component of system 100 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a first load configured to receive a flow of refrigerant from a flash tank;

at least one compressor comprising a discharge side and a suction side;

a first pipe coupled to the first load and disposed downstream of the first load and upstream of the at least one compressor;

a second pipe coupled to the suction side of the at least one compressor and disposed upstream of the at least one compressor and downstream of the first load, wherein both the first pipe and the second pipe are located between the first load and the at least one compressor;

a third pipe coupled to the first pipe and the second pipe;

a fourth pipe coupled to the first pipe and the second pipe and in parallel to the third pipe, wherein the third pipe and the fourth pipe are disposed between the first load and the at least one compressor; and a check valve coupled to the fourth pipe, wherein during a first mode of operation:

the first load is configured to use a refrigerant to cool a space proximate the first load;

the first, second, and third pipes are configured to direct refrigerant from the first load to the at least one compressor;

the at least one compressor is configured to compress refrigerant from the first load; and the check valve inhibits refrigerant from the first load from flowing to the at least one compressor through the fourth pipe; and wherein during a second mode of operation:

the first, second, and fourth pipes are configured to direct a first portion of the refrigerant from the at least one compressor to the first load to defrost the first load, wherein the first portion of the refrigerant comprises a gas from the at least one compressor, wherein the at least one compressor has compressed the refrigerant supplied by a second load, the second load is supplying heated refrigerant from the flash tank to the at least one compressor to defrost the first load; and the first load is configured to direct the first portion of the refrigerant to the flash tank disposed upstream of the first load and configured to store the refrigerant.

2. The apparatus of claim 1, wherein during the second mode of operation the third pipe is configured to direct a second portion of the refrigerant from the compressor to the first load.

3. The apparatus of claim 2, wherein the second portion is smaller than the first portion.

4. The apparatus of claim 1, wherein the third pipe is smaller in diameter than the fourth pipe.

5. The apparatus of claim 1, wherein the fourth pipe has a diameter that is less than or equal to a diameter of the first pipe.

6. The apparatus of claim 1, wherein the compressor is positioned vertically higher than the first load.

7. A method comprising:

removing, by a high side heat exchanger, heat from a refrigerant;

storing, by a flash tank, the refrigerant;

using, by a first load, the refrigerant to cool a first space proximate the first load;

using, by a second load, the refrigerant to cool a second space proximate the second load;

during a first mode of operation:

using, by a third load, the refrigerant to cool a third space proximate the third load;

directing, by a suction line coupled to the third load and to a suction side of a first compressor, refrigerant from the third load to the first compressor, wherein the suction line is disposed downstream of the third load and upstream of the first compressor;

compressing, by the first compressor, the refrigerant from the second load and the third load;

compressing, by a second compressor, the refrigerant from the first load and the first compressor; and inhibiting, by a check valve coupled to a hot gas line in parallel to the suction line, refrigerant from the third load from flowing to the first compressor through the hot gas line, wherein the hot gas line and the suction line are located between the third load and the first compressor; and during a second mode of operation:

wherein the first compressor has compressed the refrigerant supplied by the second load, wherein the second load is supplying heated refrigerant from the flash tank to the first compressor to defrost the third load;

directing, by the hot gas line, a first portion of the refrigerant from the first compressor to the third load to defrost the third load, wherein the first portion of the refrigerant comprises a gas from the compressor;

directing, by the suction line, a second portion of the refrigerant from the first compressor to the third load; and directing the first portion of the refrigerant discharged from the third load to the flash tank.

8. The method of claim 7, wherein the second portion is smaller than the first portion.

9. The method of claim 7, wherein the suction line is smaller in diameter than the hot gas line.

10. The method of claim 7, wherein the hot gas line has a diameter that is greater than or equal to a diameter of ⅝ inches.

11. The method of claim 7, wherein the first compressor is positioned vertically higher than the third load.

12. A system comprising:

a high side heat exchanger configured to remove heat from a refrigerant;

a flash tank configured to store the refrigerant;

a first load configured to use the refrigerant to cool a first space proximate the first load;

a second load configured to use the refrigerant to cool a second space proximate the second load;

a third load;

a first compressor comprising a discharge side and a suction side;

a second compressor;

a hot gas line disposed in parallel to a suction line that is coupled to the third load and to the suction side of the first compressor, wherein the suction line is disposed downstream of the third load and upstream of the first compressor, wherein the hot gas line and the suction line are located between the third load and the first compressor; and a check valve coupled to the hot gas line, wherein during a first mode of operation:

the third load is configured to use the refrigerant to cool a third space proximate the third load;

the suction line is configured to direct the refrigerant from the third load to the first compressor;

the first compressor is configured to compress the refrigerant from the second load and the third load;

the second compressor is configured to compress the refrigerant from the first load and the first compressor; and the check valve inhibits refrigerant from the third load from flowing to the first compressor through the hot gas line; and wherein during a second mode of operation, wherein the first compressor has compressed the refrigerant supplied by the second load, wherein the second load is supplying heated refrigerant from the flash tank to the first compressor to defrost the third load;

the hot gas line is configured to direct a first portion of the refrigerant from the first compressor to the third load to defrost the third load, wherein the first portion of the refrigerant comprises a gas from the compressor;

the suction line is configured to direct a second portion of the refrigerant from the first compressor to the third load; and the third load is configured to direct the first portion of the refrigerant to the flash tank.

13. The system of claim 12, wherein the second portion is smaller than the first portion.

14. The system of claim 12, wherein the suction line is smaller in diameter than the hot gas line.

15. The system of claim 12, wherein the hot gas line has a diameter that is greater than or equal to a diameter of ⅝ inches.

* * * * *